United States Patent [19]

Allison

[11] Patent Number: 4,913,479

[45] Date of Patent: Apr. 3, 1990

[54] DOOR KNOB HANDLE ATTACHMENT

[76] Inventor: Lawrence P. M. A. Allison, 1437 Peach Dr., Dublin, Ga. 31021

[21] Appl. No.: 304,238

[22] Filed: Jan. 31, 1989

[51] Int. Cl.[4] ..... F05B 1/00; F05B 3/00

[52] U.S. Cl. ..... 292/347; 292/DIG. 2

[58] Field of Search ..... 292/DIG. 2, 347, 350, 292/1; 285/410, 411, 412; 70/209, 211, 212; 16/114 R, 116 R, 118, 121, 110 R

[56] References Cited

U.S. PATENT DOCUMENTS

| | | | |
|---|---|---|---|
| 251,988 | 1/1882 | Young | 292/350 |
| 1,439,552 | 12/1922 | Jonnson | 292/DIG. 2 X |
| 1,829,444 | 3/1930 | Goebel et al. | 292/DIG. 2 X |
| 2,047,704 | 7/1936 | Podolsky | 292/350 |
| 2,756,008 | 7/1956 | Sutter | 292/347 |
| 2,801,122 | 7/1957 | Sutter | 292/347 |
| 2,827,739 | 8/1974 | Overnolser | 292/DIG. 2 X |
| 3,174,788 | 3/1965 | Williams | 292/DIG. 2 X |
| 3,237,976 | 3/1966 | Campoli | 292/350 |
| 3,575,453 | 4/1971 | Hohl | 292/347 |
| 4,018,465 | 4/1977 | Ramler | 292/347 |
| 4,223,931 | 9/1980 | Neary | 292/347 |
| 4,285,536 | 8/1981 | McCoy et al. | 292/DIG. 2 X |
| 4,397,489 | 8/1983 | Lind | 292/347 |
| 4,504,087 | 3/1985 | Pennington | 292/347 |
| 4,783,883 | 11/1988 | Szalay | 292/347 |

*Primary Examiner*—Eric K. Nicholson

*Attorney, Agent, or Firm*—Jerry T. Kearns

[57] ABSTRACT

A door knob handle attachment for securement to conventional round door knobs is formed by two mating semicircular shell members. An elongated lever extends from one shell member to enable disabled individuals to more easily open doors. The shell members each have an undercut recess lined with a resilient material for frictional engagement around a door knob. The shell members may be pivotally connected at first aligned ends and secured together at opposite aligned ends to form a circular collar. In a second embodiment, radially movable clamp members are provided in the undercut recess of each of the shell members for engagement with a conventional door knob.

5 Claims, 5 Drawing Sheets

DOOR KNOB HANDLE ATTACHMENT

BACKGROUND OF THE INVENTION

1. Field of the Invention

The present invention relates to door knob handle attachments, and more particularly pertains to a new and improved door knob handle attachment to enable disabled individuals to more easily open doors. Individuals suffering from arthritis, crippling hand deformities, loss of grasping power or missing arms are presented with an extreme obstacle in the form of the conventional round door knob. In order to overcome this problem, the present invention provides a simple attachment for conventional round door knobs which converts the door knob into a lever type door handle.

2. Description of the Prior Art

Various types of door knob handle attachments are known in the prior art. A typical example of such a door knob handle attachment is to be found in U.S. Pat. No. 3,575,453, which issued to P. Hohl on Apr. 20, 1971. This patent discloses a lever attachment for a round door knob secured by an arcuate serrated clamp. The clamp is secured around a round door knob by tightening a nut on an elongated bolt. The device is unattractive and provides no protection against the hazardous exposure of the free end of the clamping bolt. U.S. Pat. No. 4,018,465, which issued to V. Ramler on Apr. 19, 1977, discloses a lever door handle attachment which is clamped on conventional round door knobs. The device requires the existing round door knob to be drilled to receive alignment pins of the attachment. The device is thus difficult and expensive to install and cannot be removed without exposing the scarred surface of the original door knob. U.S. Pat. No. 4,223,931, which issued to R. Neary on Sept. 23, 1980, discloses a door knob handle attachment having a bifurcated end portion for insertion over the shank of a door knob. The device requires that a tapped hole be provided in the back face of the door knob, and is thus difficult and expensive to install. U.S. Pat. No. 4,397,489, which issued to W. Lind on Aug. 9, 1983, discloses an adaptor for providing a lever attachment to a round door knob. A hollow threaded cylinder has an attached lever and an interior hollow space lined with a resilient material. A threaded plug at one end of the cylinder is tightened to compress the resilient material to frictionally engage a door knob. U.S. Pat. No. 4,504,087, which issued to A. Pennington on Mar. 12, 1985, discloses a lever attachment for a rotary door knob which is formed as a split one piece unit adapted to expand to embrace a door knob. The lever is formed by two split mating portions which are secured together around the door knob by a variety of latch mechanisms. This device is unsightly because of the split construction which can also leave uncomfortable exposed edges. Additionally, the latch construction fails to securely clamp the mounting collar around the door knob, thus resulting in an insecure attachment.

While the above mentioned devices are suited for their intended usage, none of these devices disclose an inexpensive lever attachment which utilizes two mating semi-circular shell members provided with undercut recesses to completely surround and firmly engage a round door knob. Additionally, none of the aforesaid devices disclose the use of mating semi-circular shell members provided with integrally formed hinge portions and each having an arcuate undercut recess lined with a resilient material for frictional engagement with a conventional round door knob. An additional feature of the present invention, not contemplated by the aforesaid prior art devices, is the provisions of radially movable concave clamp members for allowing adaptation to round door knobs of varying size. Inasmuch as the art is relatively crowded with respect to these various types of door knob handle attachments, it can be appreciated that there is a continuing need for and interest in improvements to such door knob handle attachments, and in this respect, the present invention addresses this need and interest.

SUMMARY OF THE INVENTION

In view of the foregoing disadvantages inherent in the known types of door knob handle attachments now present in the prior art, the present invention provides an improved door knob handle attachment. As such, the general purpose of the present invention, which will be described subsequently in greater detail, is to provide a new and improved door knob handle attachment which has all the advantages of the prior art door knob handle attachments and none of the disadvantages.

To attain this, representative embodiments of the concepts of the present invention are illustrated in the drawings and make use of a door knob handle attachment, for securement to conventional round door knobs, formed by two mating semicircular shell members. An elongated lever extends from one shell member to enable disabled individuals to more easily open doors. The shell members each have an undercut recess lined with a resilient material for frictional engagement around a door knob. The shell members may be pivotally connected at first aligned ends and secured together at opposite aligned ends to form a circular collar. In a second embodiment, radially movable clamp members are provided in the undercut recess of each of the shell members for engagement with a conventional door knob.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door knob handle attachment which has all the advantages of the prior art door knob handle attachments and none of the disadvantages.

It is another object of the present invention to provide a new and improved door knob handle attachment which may be easily and efficiently manufactured and marketed.

It is a further object of the present invention to provide a new and improved door knob handle attachment which is of a durable and reliable construction.

An even further object of the present invention is to provide a new and improved door knob handle attachment which is susceptible of a low cost of manufacture with regard to both materials and labor, and which accordingly is then susceptible of low prices of sale to the consuming public, thereby making such door knob handle attachments economically available to the buying public.

Still yet another object of the present invention is to provide a new and improved door knob handle attachment which provides in the apparatuses and methods of the prior art some of the advantages thereof, while simultaneously overcoming some of the disadvantages normally associated therewith.

Still another object of the present invention is to provide a new and improved door knob handle attachment to enable disabled individuals to more easily open doors equipped with conventional round door knobs.

Yet another object of the present invention is to provide a new and improved door knob handle attachment which securely surrounds and frictionally engages the outer surface of a conventional round door knob.

Even still another object of the present invention is to provide a new and improved door knob handle attachment having radially movable clamp members lined with a resilient material for frictional engagement with round door knobs of various different sizes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, refeence should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
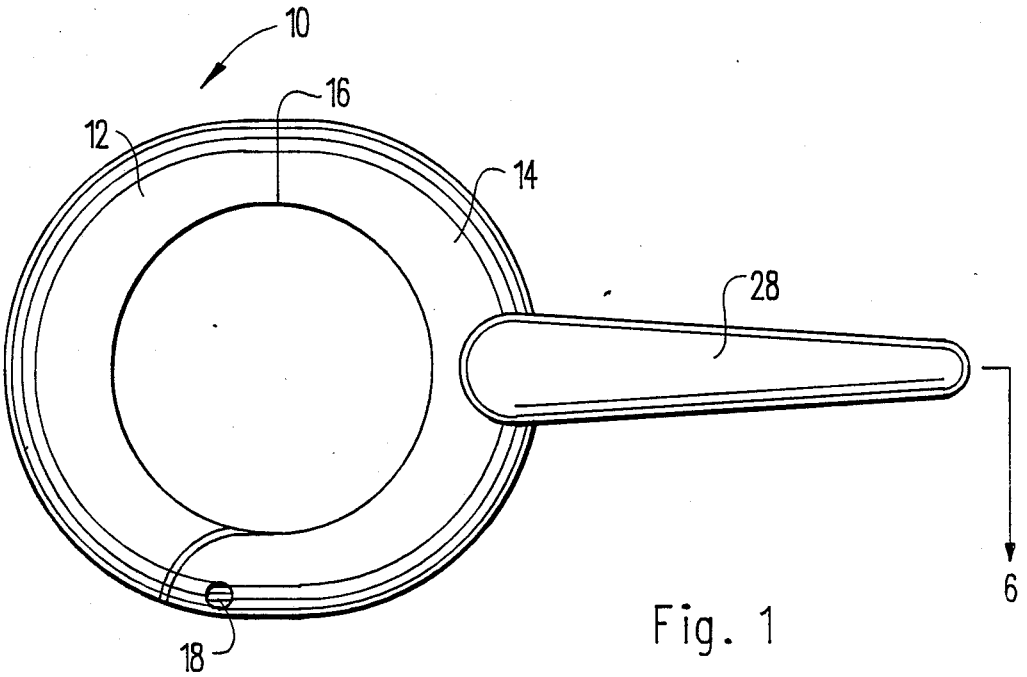
FIG. 1 is a front view of the door knob handle attachment according to the first embodiment of the present invention, with the semi-circular shell members secured in a closed position.

With reference now to the drawings, and in particular to FIG. 1 thereof, a new and improved door knob handle attachment embodying the principles and concepts of the present invention and generally designated by the reference numeral 10 will be described.

More specifically, it will be noted that the first embodiment 10 of the invention includes a first semi-circular shell member 12 and a mating second semi-circular shell member 14. The shell members 12 and 14 are pivotally connected by hinge pin 18 at first aligned ends thereof. The opposite aligned ends of the shell members 12 and 14 meet at a joint 16. A lever 28 extends outwardly from the shell member 14 for manipulation by a disabled individual to rotate a conventional round door knob. In use, the shell members 12 and 14 are secured around a conventional round door knob and are frictionally engaged therewith.

Figure 2:
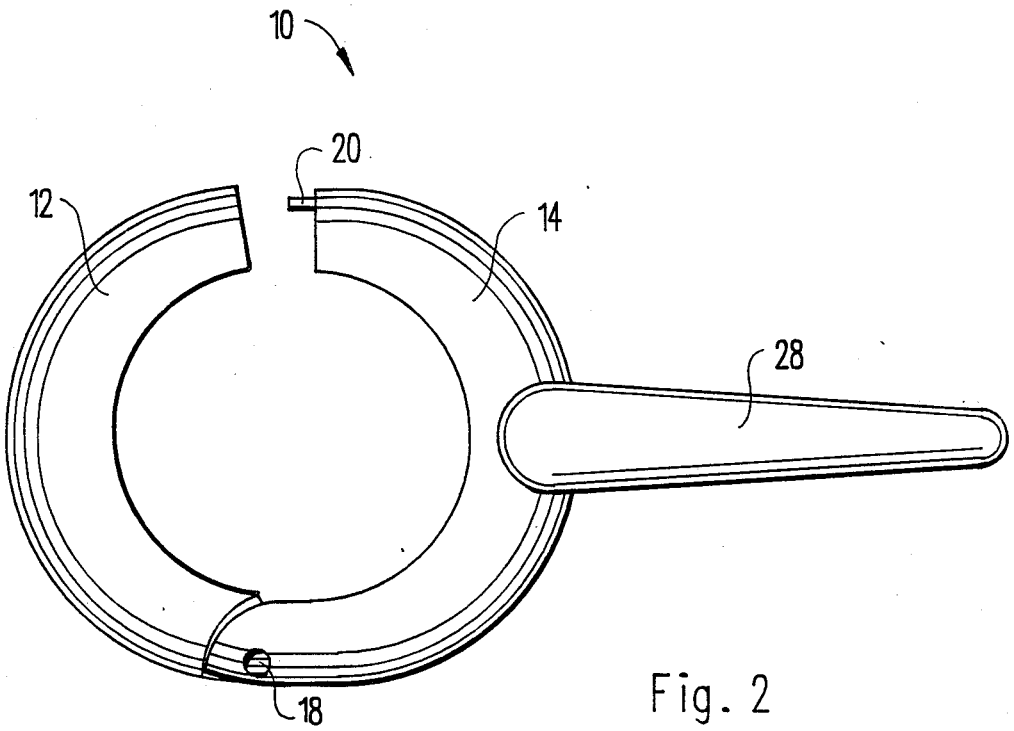
FIG. 2 is a front of the door knob handle attachment of FIG. 1, with the shell members in a slightly open position.

FIG. 2 illustrates the shell members 12 and 14 in partially open position, as required for installment on a conventional door knob. The halves 12 and 14 are secured together by conventional threaded fasteners such as for example the screw 20.

Figure 3:
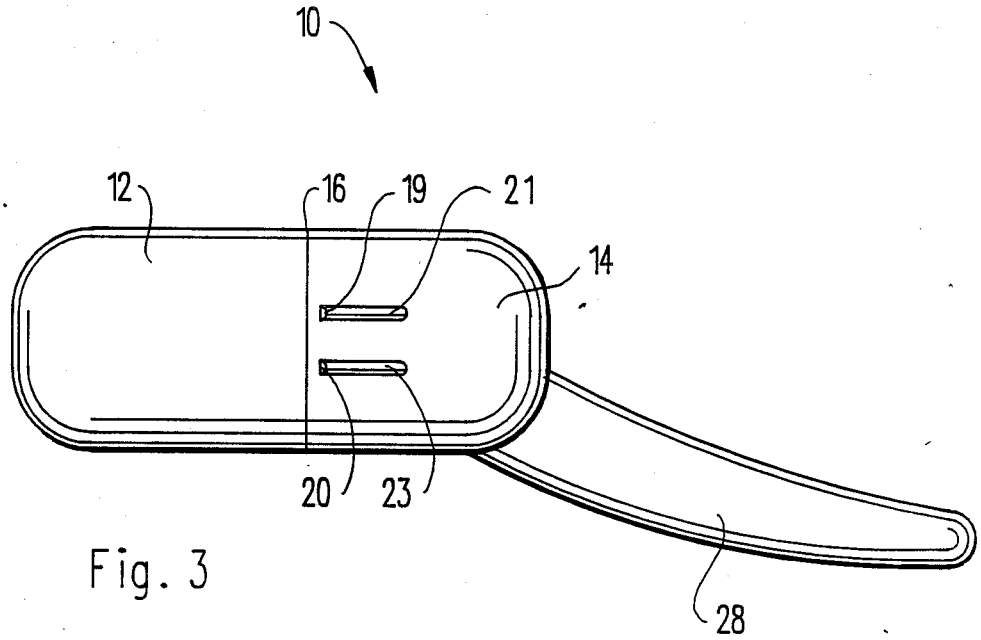
FIG. 3 is a side view of the door knob handle attachment of FIG. 1.

As shown in the side view of FIG. 3, access slots 21 and 23 may be provided in the side wall of the shell member 14 to enable installation of the screws 19 and 20. The shell member 12 is provided with suitable threaded apertures for engagement with the screws 19 and 20.

Figure 4:
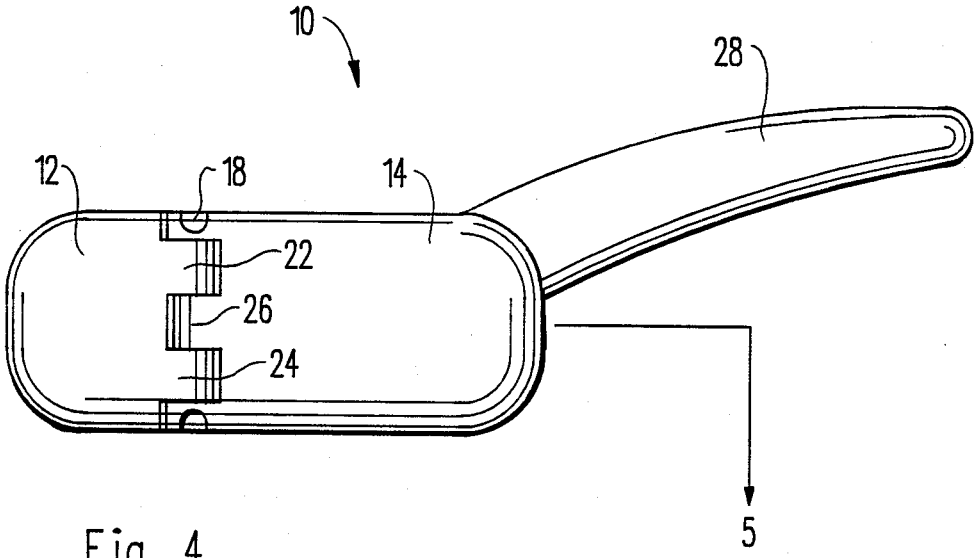
FIG. 4 is an opposite side view of the door knob handle attachment of FIG. 1.

FIG. 4 is an opposite side view which illustrates the integral hinge portions 22 and 24 formed on the shell member 12 and dimensioned for cooperation with the hinge member 26 formed on the shell member 14. A hinge pin 18 extends through the mating hinge members thus pivotally securing the aligned ends of the shell members 12 and 14.

Figure 5:
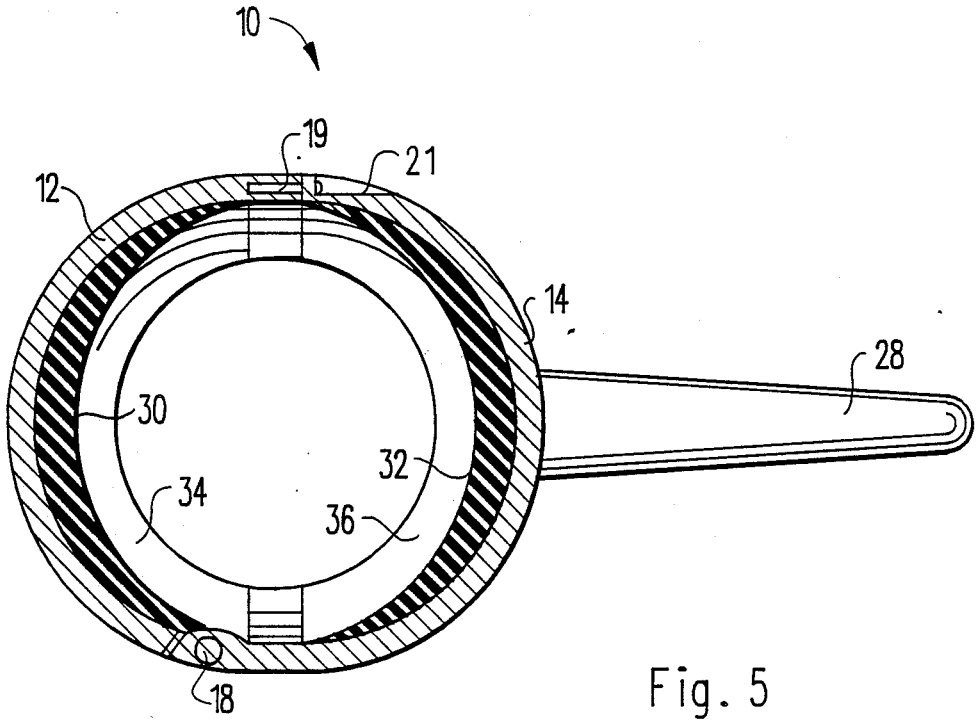
FIG. 5 is a cross sectional view, taken along line 5 of FIG. 4.

As shown in FIG. 5, each of the shell members 12 and 14 is provided with a respective interior arcuate undercut groove 34 and 36. These undercut grooves are lined with a resilient elastomeric material 30 and 32. A suitable material is rubber. The resilient linings 30 and 32 serve to frictionally engage the side portions of a conventional round door knob and allow for some variation in the size of the conventional door knob.

Figure 6:
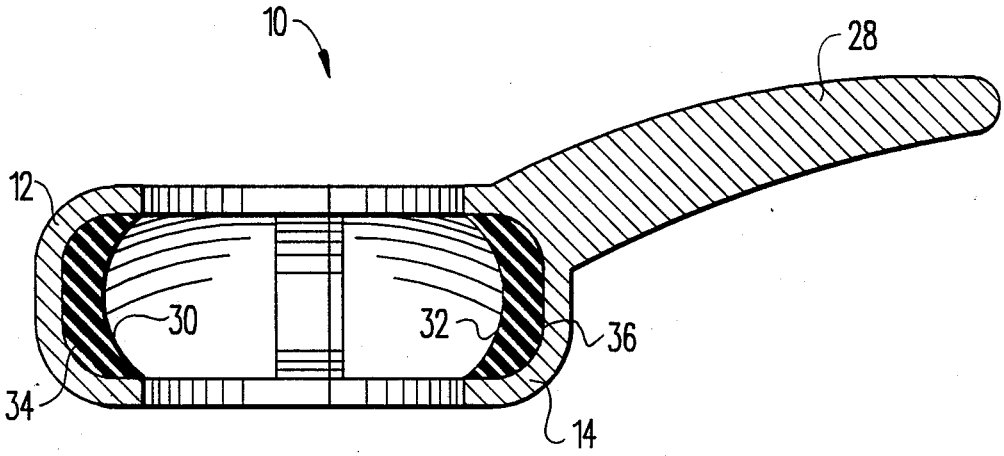
FIG. 6 is a longitudinal cross sectional view, taken along line 6 of FIG. 1.

As shown in the cross sectional view of FIG. 6, the linings 30 and 32 have an arcuate configuration to match the shape of the conventional round door knob.

Figure 7:
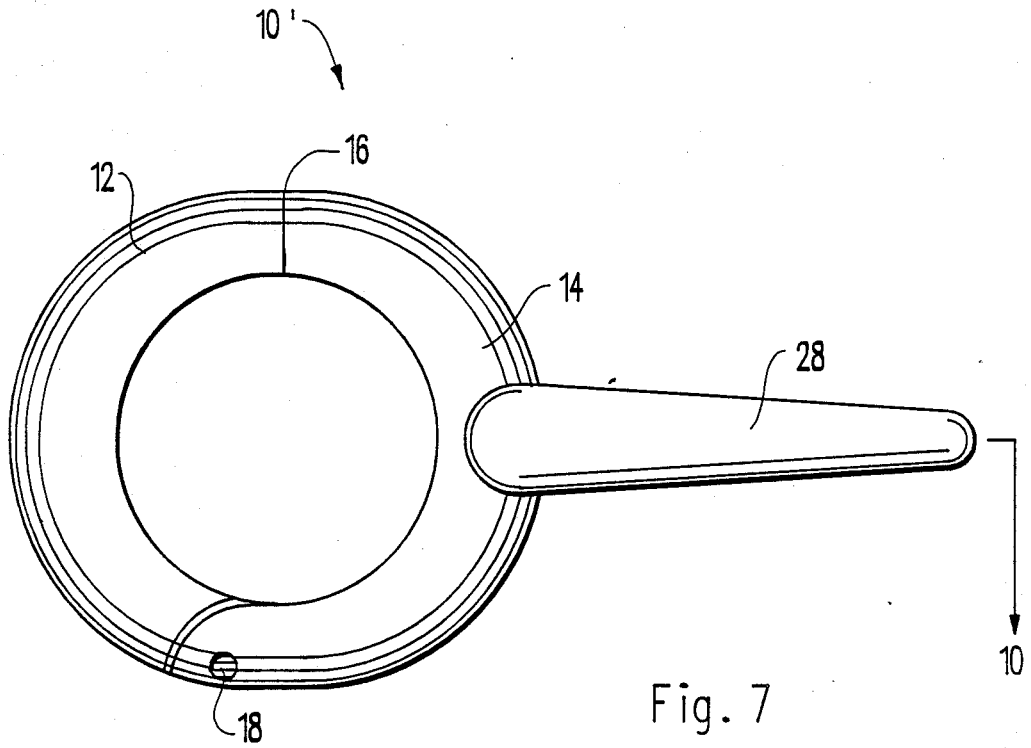
FIG. 7 is a front view of a door knob handle attachment according to a slightly modified second embodiment of the present invention.

FIG. 7 provides a front view illustrating a second embodiment 10' of the invention, which is generally similar in construction to the first embodiment 10, with like reference numerals designating similar parts.

Figure 8:
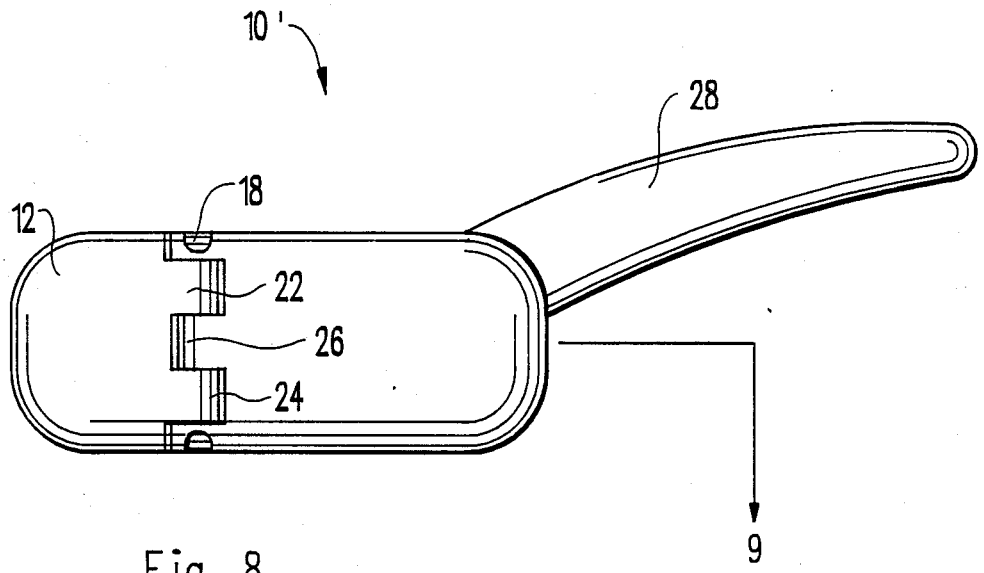
FIG. 8 is a side view of the door knob handle attachment of FIG. 7.

FIG. 8 illustrates a side view of the second embodiment 10'.

Figure 9:
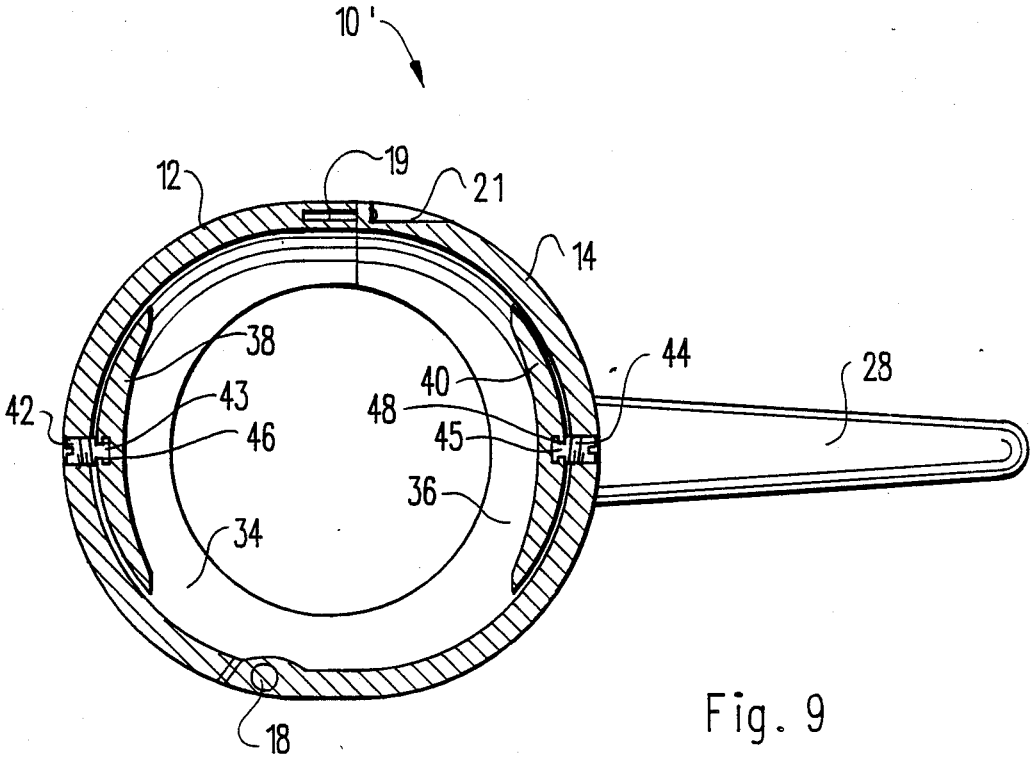
FIG. 9 is a transverse cross sectional view, taken along line 9 of FIG. 8.

As shown in the cross sectional view of FIG. 9, a pair of radially movable clamp members 38 and 40 are provided in the undercut grooves 34 and 36 within the shell members 12 and 14. The clamp member 38 has an arcuate concave configuration dimensioned for engagement with the side wall of a conventional round door knob. The clamp member 38 has an enlarged T-slot portion 46 which receives the head of a set screw 42 for free rotation. Thus, the clamp 38 will be moved radially inwardly upon rotation of the set screw 42. A similar arrangement is provided for securement of the enlarged head 45 of a set screw 44 within a T-slot portion 48 of the clamp member 40. The radially movable clamp members 38 and 40 provide for a secure frictional engagement of the attachment 10' on a conventional round door knob, and also allow adaptation for a substantial variation in size of the conventional door knob.

Figure 10:
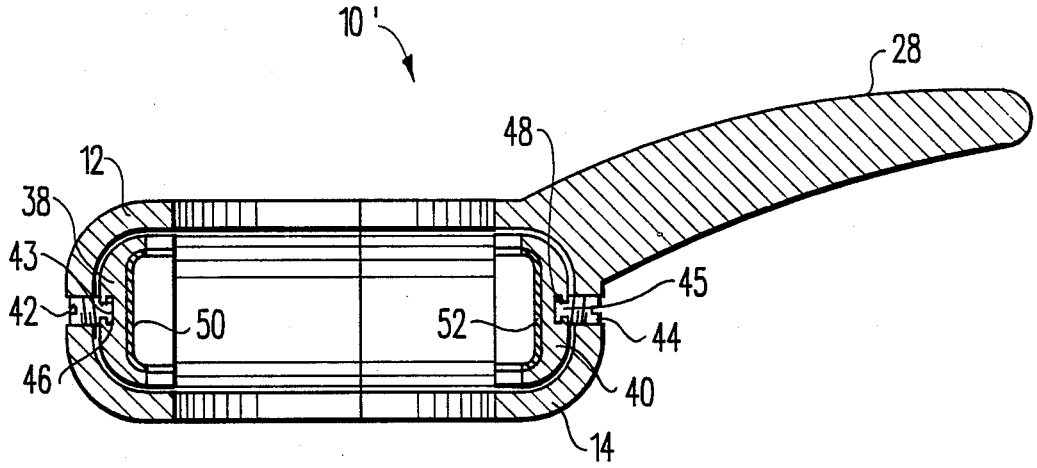
FIG. 10 is a longitudinal cross sectional view, taken along line 10 of FIG. 7.

As shown in FIG. 10, the clamp members 38 and 40 may be provided with a resilient lining 50 and 52 of a material such as rubber. This provides for a secure frictional engagement, and also prevents marring the surface finished of a conventional door knob. The various components of the first 10 and the second 10' embodiments of the present invention may be formed from a high impact plastic material which may be suitably colored to match a variety of decors. Alternatively, the device may be formed from metal such as aluminum. In either case, it should be understood that the device of the present invention is extremely inexpensive to manufacture and provides an effective attachment which may be retrofitted to conventional door knobs without requiring any modifications thereof. The device presents only smooth exterior surfaces and thus eliminates the potential for injury inherent with the prior art devices.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered a illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door knob handle attachment, comprising:

a pair of mating semi-circular shell members;

means pivotally connecting said shell members at first aligned ends thereof;

means for selectively securing opposite ends of each of said shell members together to form a circular collar;

an elongated lever secured to one of said shell members;

each of said shell members having an interior undercut recess dimensioned for engagement with a door knob;

a radially movable clamp member disposed in the undercut recess of each of said shell members;

a set screw extending through each of said shell members and connected to one of said clamp members for radially moving said clamp members; and each of said set screws having a head portion mounted for free rotation with respect to one of said clamp members and fixed for radial movement therewith.

2. The door knob handle attachment of claim 1, wherein said means for securing said shell members together comprises threaded fastener means.

3. The door knob handle attachment of claim 1, wherein said means pivotally connecting said shell members comprises mating hinge portions integrally formed on said shell members.

4. The door knob handle attachment of claim 1, wherein each of said clamp members comprises an arcuate body portion having a concave portion dimensioned for engagement with a door knob.

5. The door knob handle attachment of claim 4, wherein each of said clamp body portions are lined with a resilient material.

* * * * *